United States Patent [19]

Malone

[11] 4,281,466

[45] Aug. 4, 1981

[54] BOWLING SHOE PROTECTOR

[76] Inventor: Blanche M. Malone, 2822 Dogwood Pl., Nashville, Tenn. 37204

[21] Appl. No.: 104,078

[22] Filed: Dec. 17, 1979

[51] Int. Cl.[3] ..... A43B 3/16; A43B 1/02; A43B 11/00; A43B 5/00

[52] U.S. Cl. ..... 36/7.1 R; 36/9 R; 36/50; 36/130

[58] Field of Search ..... 36/9 R, 7.1 R, 7.3, 36/10, 50, 130

[56] References Cited

U.S. PATENT DOCUMENTS

| | | | |
|---|---|---|---|
| 2,729,899 | 1/1956 | Haase | 36/7.1 R |
| 3,032,898 | 5/1962 | Servin | 36/9 R |
| 3,052,046 | 9/1962 | Kramer | 36/9 R |
| 3,120,711 | 2/1964 | Scholl | 36/9 R |
| 3,798,503 | 3/1974 | Larsh et al. | 36/9 R |

*Primary Examiner*—Patrick D. Lawson
*Attorney, Agent, or Firm*—Abe Hatcher

[57] ABSTRACT

An expandible slip-over protector elasticized at the top and adapted to cover most or all of a bowling shoe has a zipper to go over shoestrings, a flexible, non-absorbent sole fabric under the zipper for protecting the shoestrings and a stabilizer strip centrally located in the heel portion.

6 Claims, 4 Drawing Figures

BOWLING SHOE PROTECTOR

BACKGROUND OF THE INVENTION

1. Field of the Invention

This invention relates to shoe protectors. More particularly, it relates to an expandible, reinforced bowling shoe protector.

2. Description of the Prior Art

Bowling shoe protectors exemplified by those of U.S. Pat. Nos. 3,040,451, 3,012,343 and 3,609,888 not only do not protect all of the areas of a bowling shoe that require protection but are difficult for a bowler to put on when he or she wishes to leave the lanes for a short time.

SUMMARY OF THE INVENTION

After extended investigation I have developed a bowling shoe protector adapted to cover most or all of the shoe and of a substantially one-piece reinforced, expandible structure so that it can be put on almost instantaneously. In its broader aspects my invention comprises a bowling shoe protector made up generally of a fabric body or side portion going all the way around the back and front and elasticized around its top, reinforced by a flexible non-absorbent sole joined to said fabric body or side portion, for example, by stitching, glueing or the like and having a centrally positioned zipper in front. For further reinforcement I prefer to employ vertical strip or support bar in the back. My zipper is preferably fitted in stretch pleate elastic and has a protective strip adapted to fit thereunder to protect shoestrings.

BRIEF DESCRIPTION OF THE DRAWING AND OF THE PREFERRED EMBODIMENT OF THE INVENTION

For a better understanding of my invention reference will now be made to the drawing, which is illustrative of the invention and represents the preferred embodiment thereof.

Figure 1:
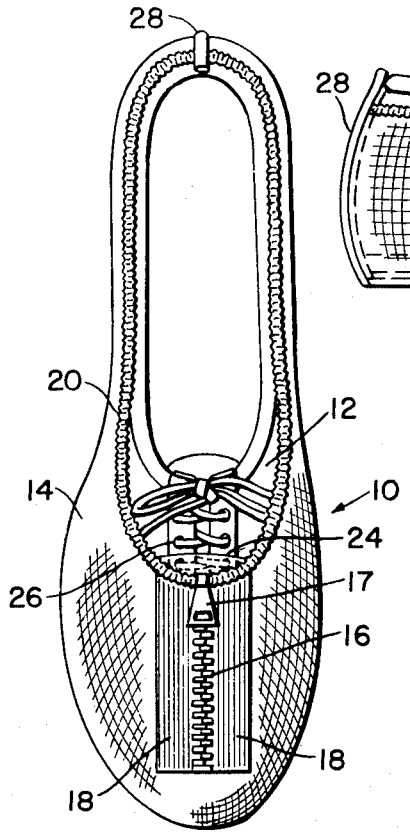
FIG. 1 is a plan view of the bowling shoe protector of the invention shown installed on a shoe to be protected.
Figure 2:
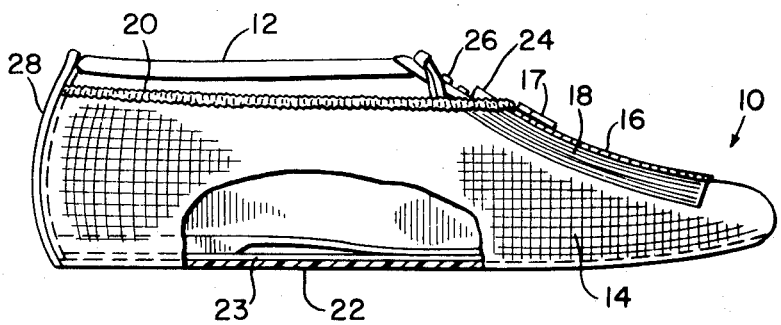
FIG. 2 is a side view of the bowling shoe protector of FIG. 1, partially broken away to show the non-absorbent sole portion thereof.
Figure 3:
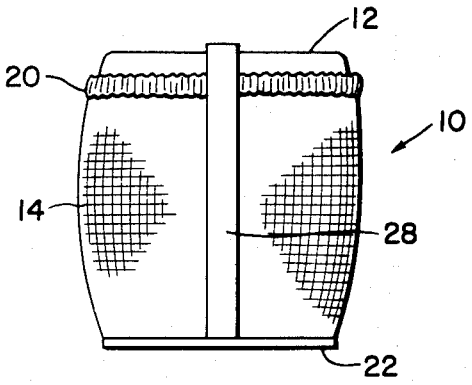
FIG. 3 is a rear view showing the vertical strip or support bar in the heel portion of the protector.
Figure 4:
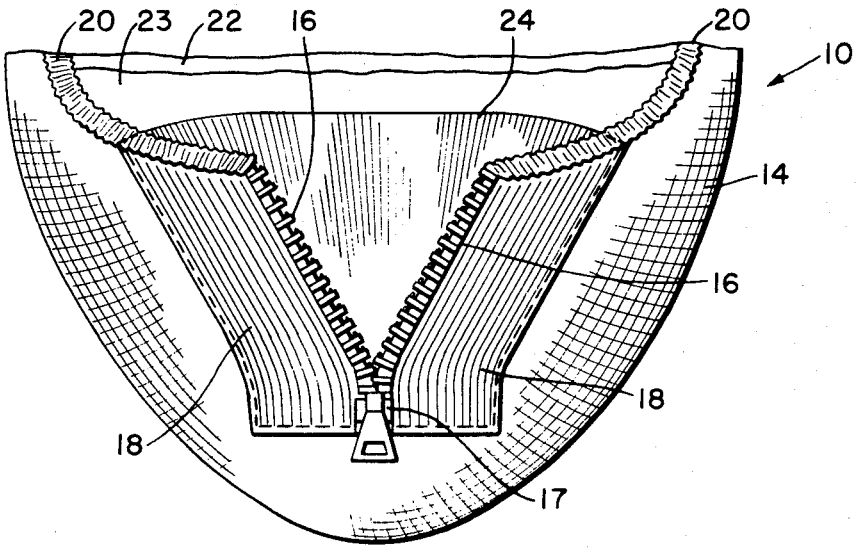
FIG. 4 is a view which shows the protector unzipped so as to reveal the pleated elastic material and the protective strip under the zipper for protecting the strings of the shoe over which the shoe protector is worn.

In the drawing, bowling shoe protector 10, made up generally of a fabric body 14, for example, elastic or stretchable nylon, which surrounds or envelopes bowling shoe 12, reaching nearly to, or all the way to, the top of the shoe, includes a zipper 16 up front which runs along a track or carriage 17 set in stretchable pleated material 18 on each side and covering a protective strip 24, sewn or otherwise joined on at least one side, and preferably also at the bottom, to the fabric body 14, said zipper 16, track or carriage 17, pleated material 18 and protective strip 24 covering or overlying shoestrings 26 of the bowling shoe 12, an elastic band or strip 20 around the top of the fabric body 14, a support bar 28 at the center or middle of the heel portion of the fabric body 14 and a substantially non-absorbent and water and foreign matter-repellent sole 22, for example, natural or synthetic rubber, which may be treated, if desired, to make it less absorbent, the non-absorbent sole 22 fitting over inner sole 23 of the bowling shoe 12.

While the invention has been described in terms of preferred embodiments, the claims appended hereto are intended to encompass all embodiments which fall within the spirit of the invention.

Having this described my invention and certain preferred embodiments thereof, I claim:

1. A bowling shoe protector comprising a stretchable fabric body adapted to fit snugly around a bowling shoe, an elastic strip around the top of said fabric body, a zipper at one end of said fabric body adapted to be zipped into an open position for ease in fitting said protector over said shoe and flexible substantially non-absorbent sole joined to said fabric body.

2. The bowling shoe protector of claim 1 having a support bar substantially at the middle of one end of the fabric body.

3. The bowling shoe protector of claim 1 wherein the flexible substantially non-absorbent sole comprises material selected from the group consisting of natural rubber and synthetic rubber.

4. A bowling shoe protector comprising a stretchable fabric body adapted to fit snugly around a bowling shoe, an elastic strip around the top of said fabric body, a zipper at one end of said fabric body adapted to be zipped into an open position for ease in fitting said protector over said shoe and a substantially non-absorbent sole joined to said fabric body, said bowling shoe protector having a pleated material on each side of a carriage for said zipper.

5. A bowling shoe protector comprising a stretchable fabric body adapted to fit snugly around a bowling shoe, an elastic strip around the top of said fabric body, a zipper at one end of said fabric body adapted to be zipped into an open position for ease in fitting said protector to said fabric body, said bowling shoe protector having a protective strip under the upper portion at one end of said fabric body.

6. A bowling shoe protector comprising a stretchable fabric body adapted to fit snugly around a bowling shoe, an elastic strip around the top of said fabric body, a zipper in a carriage at one end of said fabric body substantially midway the front adapted to be zipped into an open position for ease in fitting said protector over said shoe, a support bar substantially midway the rear of said fabric body, said zipper and carriage having a stretch pleate on each side thereof and a protective strip under said zipper and carriage joined on each side and at the bottom in front to said fabric body and a substantially non-absorbent sole joined to said fabric body.

* * * * *